US006454814B1

(12) United States Patent
Xu et al.

(10) Patent No.: US 6,454,814 B1
(45) Date of Patent: Sep. 24, 2002

(54) TREATMENT OF FABRICS

(75) Inventors: Weilin Xu; Yi Li; Kwok Wing Yeung; Kwok Yi Lin, all of Kowloon (HK)

(73) Assignee: Hong Kong Polytechnic University, Kowloon (HK)

( * ) Notice: Subject to any disclaimer, the term of this patent is extended or adjusted under 35 U.S.C. 154(b) by 197 days.

(21) Appl. No.: 09/665,061

(22) Filed: Sep. 19, 2000

(51) Int. Cl.[7] ..... D06M 13/00; D06M 23/00; D06M 13/12; D06M 11/00

(52) U.S. Cl. ..... 8/116.1; 8/116.4

(58) Field of Search ..... 8/116.1, 116.4

(56) References Cited

U.S. PATENT DOCUMENTS 3,201,336 A 8/1965 Magat et al. ..... 204/154
3,252,880 A 5/1966 Magat et al. ..... 204/154
3,423,163 A 1/1969 Magat et al. ..... 8/116.3
3,514,385 A 5/1970 Magat et al. ..... 204/159.12
4,036,588 A 7/1977 Williams et al. ..... 8/130.1
4,065,256 A * 12/1977 Igeta et al. ..... 8/115.5
4,806,125 A * 2/1989 Dyer ..... 8/116.1

* cited by examiner

*Primary Examiner*—Gregory Delcotto
*Assistant Examiner*—Preeti Kumar
(74) *Attorney, Agent, or Firm*—Leydig, Voit & Mayer, Ltd.

(57) ABSTRACT

A method of treating a fabric including cellulose fiber to increase water absorption and hydrophilicity by graft polymerisation. The method includes pre-treating the fabric in a solution of an inhibitor for about one hour, and washing the fabric to remove excess inhibitor solution. The fabric is placed in a grafting solution of a hydrophilic monomer for about three hours, washed in methanol, and decrystallized in a solution of zinc chloride for about one hour. The decrystallised fabric is then treated in a solution of sodium hydroxide at 50° C. for about one hour.

6 Claims, No Drawings

TREATMENT OF FABRICS

BACKGROUND OF THE INVENTION

1. Field of the Invention

The invention relates to treatment of fabrics.

2. Description of Prior Art

Many fabrics are inherently or otherwise impervious to water and therefore difficult to wash. If the surface of the fabric is treated to improve washability, the effect of the treatment significantly deteriorates or is removed by subsequent and normal washing operations.

The present invention is applicable to cotton/polyester blended fabric. Many proposals have been made already to increase the water absorbency or hydrophilicity of cellulose-containing materials. Most of such proposals use graft-copolymerisation with a monomer containing hydrophilic groups on the cellulose containing material. The usual method uses graft copolymerisation with monomers such as acrylonitrile and/or acrylate and methacrylate ester followed by alkaline hydrolysis. Only a low homopolymer is formed.

In the Journal of Applied Polymer Science Vol. 25(1980) at page 535, J. L. William et al have described a method of hydrophilic treatment of cellulose containing materials. A similar method is described in Progress Polymer Science Vol. 10(1984) at page 1. U.S. Pat. No. 3,423,163 discloses a method of increasing moisture absorbing properties of cellulose materials by graft copolymerisation using N-methylolacrylamide. U.S. Pat. No. 3,252,880 discloses that a base polymer may be rendered more hydrophilic by grafting thereon suitable monomer materials. U.S. Pat. No. 3,514,385 discloses the grafting of various acrylic compounds to cellulosic base materials in order to increase the hydrophilicity of the resulting products. U.S. Pat. No. 3,201,336 further discloses grafting arcylic monomers onto cellulosic-based materials. U.S. Pat. No. 4,036,588 discloses the grafting copolymerization of various kinds of hydrophilic monomers onto cellulose-containing materials after the materials have been treated by gamma rays, and then the grafted fibers are treated by post-decrystallization using a solution of zinc chloride.

The products obtained by the above stated methods have good ion-exchange properties, and good water absorbency provided by their alkali metal salts. However, when the above treatments are applied to cotton containing fabrics, serious strength loss is observed, which greatly prevents their use on many occasions and the fabric may not be reusable.

SUMMARY OF THE INVENTION

It is an object of the invention to overcome or at least reduce this problem.

According to the invention there is provided a method of treating cellulose fibre or blended fiber pieces thereof, to increase water absorptive and hydrophilicity by graft polymerisation, the method comprising the steps of pre-treating the piece in a solution of an inhibitor for about one hour, washing the piece to remove excess inhibitor solution, placing the piece in a grafting solution of hydrophillic monomer for about three hours, washing in methanol, decrystallise treating the piece using a solution of zinc chloride for about one hour, and then treating the decrystallised piece in a solution of sodium hydroxide at 50° C. for about one hour.

The blend fabric may be a cotton/polyester blend.

The inhibitor may be ceric ammonium sulphate.

The inhibitor may be potassium persulfate (KPS).

The grafting solution may be acrylic tetrachloroethylene.

The grafting solution may be methyacrylic acid.

DETAILED DESCRIPTION

A method according to the invention will now be described by way of example.

A fabric sample of cotton/polyester blend fabric sample is immersed in a solution of 0.15 mo/L ceric ammonium sulphate solution for one hour. The sample is washed (to remove any excess solution). The sample is then placed in a methacrylic solution of tetrachloroethylene for approximately three hours. The sample is then removed and thoroughly washed (in purified water). The sample is then decrystallised by treatment in a solution of 70% zinc chloride at 40° C. for one hour. The decrystallised sample is then placed in a solution of 3% sodium hydroxide at 50° C. for one hour. This converts zinc salts present to sodium salts. As polyester in the fabric sample cannot be modified by the sodium hydroxide, the fabric strength is not reduced in this last step of the method.

Moisture regain values were measured by drying the fabric sample for twelve hours in a vacuum oven and then re-weighing the fabric sample. The sample was then conditioned in a normal atmosphere of at 20° C. and 65% relative humidity, and re-weighed. The water retention value (WRV) was then determined by immersing the fabric sample (dimensions 2×8 cm) in water lengthwise, with 0.5 cm under the surface of the water. The time for the sample to become totally wet, due to its wicking property, is used to calculate the WRV.

The results are shown in Tables 1 and 2

The results of both grafted samples without further treatment and samples with further treatment using 3% sodium hydroxide and 70% zinc chloride are shown in Table 1. As the graft add-on increases, the moisture regain of the grafted samples with further treatment increases very rapidly, almost linearly increasing. The value is much larger than that of the samples without further treatment by zinc chloride and sodium hydroxide. The further treatment can transform the copolymers into sodium salts and lead to a dramatic increase in both the moisture regains and the WRV's.

The water retention value of the grafted samples are shown in Table 2. Wicking speed can demonstrate water absorbency of the samples in some degree; the speed is tested by immersing one end of the fabric in water (0.5 cm) vertically as mentioned above. Table 2 shows the grafted samples without further treatment have little change, and the wicking speed decreases to some degree. However, the wicking speed and WRV of the samples with further treatment increase very rapidly. This phenomena shows that the decrystallizing acrylic graft copolymers of cellulose are excellent for water absorbency.

TABLE 1

Moisture regain of the grafted samples

| Graft add-on, % | Samples without further treatment Moisture regain, % | Samples with further treatment Moisture regain, % |
|---|---|---|
| 0 | 5.4 | 11.8 |
| 26.8 | 6.3 | 18.5 |
| 43.24 | 6.9 | 22.7 |
| 64.04 | 8.1 | 26.2 |

TABLE 2

Water absorbency and wicking properties of the grafted samples

| Samples without further treatment | | | Samples with further treatment | | |
|---|---|---|---|---|---|
| Graft add-on, % | WRV, % | Wicking speed, cm/min | Graft add-on, % | WRV, % | Wicking speed, cm/min |
| 0 | 103.8 | 1.14 | 0 | 157.5 | 0.727 |
| 14.46 | 132.6 | 1.14 | 26.8 | 253.2 | 1.60 |
| 43.24 | 120.1 | 0.50 | 64.06 | 350.1 | 2.67 |
| 59.56 | 127.3 | 0.222 | | | |

Cotton/polyester blend yarn woven fabric or knitted fabric can be treated to achieve the required properties. The graft-copolymerization can-be initiated by suitable free-radical initiators such as ceric ion, ferrous ion-hydrogen peroxide, etc. In the copolymerization initiated by ceric ion, the ceric acid (CAN) is reagent grade. Many kinds of vinyl agents containing hydrophilic groups can be grafted onto the fabrics. All the monomers must be purified by distilling under vacuum in the presence of copper powder to prevent polymerization.

Other vinyl monomers, dimers, or oligomers capable of graft copolymerization with cellulose and which contain a hydrophilic group may also be grafted on the cellulose fiber in the cellulose/polyester blend fabric. Processing is similar to the above. But, preferably in the hydrophilic treatment of the textiles, acrylic acid and methacrylic acid are used.

We claim:

1. A method of treating cellulose fabric fibres to increase water absorption and hydrophilicity by graft polymerisation, the method comprising pre-treating the fabric in a solution of an inhibitor for about one hour, washing the fabric to remove excess inhibitor, placing the fabric in a grafting solution of a hydrophillic monomer for about three hours, washing in methanol, decrystallising the fabric in a solution of zinc chloride for about one hour, and treating the fabric after decrystallizing in a solution of sodium hydroxide at 50° C. for about one hour.

2. The method of treating a fabric according to claim 1, in which the fabric is a cotton/polyester blend.

3. The method of treating a fabric according to claim 1, wherein the inhibitor is ceric ammonium sulphate.

4. The method of treating a fabric according to claim 1, wherein the inhibitor is potassium persulfate.

5. The method of treating a fabric according to claim 1, wherein the grafting solution comprises acrylic tetrachloro-ethylene.

6. The method of treating a fabric according to claim 1, wherein the grafting solution comprises methyacrylic acid.

* * * * *